United States Patent [19]

Lorenz

[11] 4,387,557

[45] Jun. 14, 1983

[54] FALSE TWISTING APPARATUS AND METHOD

[75] Inventor: Hellmut Lorenz, Remscheid-Lennep, Fed. Rep. of Germany

[73] Assignee: Barmag Barmer Maschinenfabrik AG, Remscheid, Fed. Rep. of Germany

[21] Appl. No.: 272,939

[22] Filed: Jun. 12, 1981

[30] Foreign Application Priority Data

Mar. 21, 1981 [DE] Fed. Rep. of Germany ..... 3111245

[51] Int. Cl.[3] ..... D02G 1/08

[52] U.S. Cl. ..... 57/340; 57/339; 57/348

[58] Field of Search ..... 57/334–340, 57/348, 349, 104, 105

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,047,374 | 9/1977 | Venot | 57/338 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/338 |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus and method is provided which permits ready conversion from S to Z twist, or vice versa. The apparatus comprises a pair of friction discs which are rotatably mounted on a common carrier plate, and the carrier plate is pivotally mounted to the frame of the apparatus such that the discs may be selectively rotated between first and second operative positions disposed 180 degrees from each other. The discs are rotated in a common rotational direction in each operative position, and the yarn is advanced through a twisting zone between the discs in a direction parallel to a line extending perpendicularly between the axes of rotation of the discs. Thus conversion from S to Z twist, or vice versa, may be effected by pivoting the carrier plate between the two operative positions, without changing the direction of rotation of the discs or the yarn path of travel.

10 Claims, 4 Drawing Figures

FALSE TWISTING APPARATUS AND METHOD

The present application relates to an improved yarn false twisting apparatus and method, of the type disclosed in commonly owned copending application Ser. No. 168,734, filed July 14, 1980, now U.S. Pat. No. 4,339,915.

Yarn false twisting apparatus for the false twist texturing of synthetic filaments are known, and which consist of two circular discs which are rotated in opposite directions. Typically, the axes of rotation are inclined toward each other and the peripheral edges of the discs contact each other at the twisting zone. In one apparatus of this type, note German Publication (AS) No. 1,192,779, and U.S. Pat. No. 4,145,871, the rotary discs are movable in the axial direction toward and away from each other and the discs are mechanically pressed against each other by spring pressure. The yarn is advanced along a path of travel which extends in a direction essentially perpendicular to the common plane of the two axes of rotation.

It is an object of the present invention to provide a yarn false twisting apparatus of the described type, which is of simplified construction and easy to operate. This object is achieved in the illustrated embodiment of the present invention in that the yarn path of travel is essentially parallel to the common plane of the two axes of rotation of the discs, with the discs being rotated in a common rotational direction. In this regard, it will be understood that the axes of rotation may be slightly inclined toward each other by a few degrees, and the term "common plane" is intended to encompass such structure. However, it is preferred that the axes are aligned parallel to each other. Further, it is preferred that at least one of the discs be flexible or pliable, and that a pressure applying member be provided for locally biasing the one flexible disc toward the other disc locally at the twisting zone.

It is a further object of the present invention to provide a very simple apparatus and method by which the twist imparted to the yarn may be converted from S to Z, or vice versa. In this regard, the drive shafts of the friction discs are mounted on a common carrier plate, and the carrier plate is pivotally mounted to the frame of the apparatus by means of a stationary pin. More particularly, the carrier plate is pivotally mounted to the frame for selective rotation between first and second operative positions which are disposed approximately 180 degrees from each other, and such that conversion from S to Z twist or vice versa may be readily effected by pivoting the carrier plate between the first and second operative positions, and without changing the direction of rotation of the discs or the yarn path of travel. Further, the position of the pressure applying member is also unchanged.

In the illustrated embodiment, each disc includes a drive shaft having a whorl mounted on one end thereof, and upon pivoting the carrier plate between the first and second operative positions, the whorl of one disc is in contact with an endless tangential belt running in a horizontal direction along the length of the false twist machine, and the two shafts are operatively interconnected by a common drive belt, such as a toothed belt. Upon pivoting to the other operative position, the whorl of the other drive shaft is operatively contacted by the tangential belt, to thereby reverse the direction of twist imparted to the yarn.

In the specific illustrated embodiments of the invention, there is also provision for selectively adjusting the ratio of twist to yarn conveyance which is imparted by the false twist apparatus, to thereby increase the denier range of the yarns which may be processed with the apparatus of the present invention, and to adapt it to the most favorable operating conditions. Thus for example, the twisting zone at which the two discs nip the yarn between their two opposing friction surfaces, may be adjusted by changing the distance between the drive shafts, such that both the circumferential speed at the twisting zone and the direction and magnitude of the force components which act on the yarn, may be varied without changing the speed of the tangential drive belt. In this regard, a tensioning device may be provided for the toothed belt drive on the common carrier plate so that when the center to center distance of the friction discs is changed, the toothed belt is automatically maintained under tension by a spring force.

The pressure applying member may be maintained at a fixed location with respect to the friction discs, since it does not need to be relocated when the direction of twist is changed in accordance with the present invention. This feature permits a simplified and relatively inexpensive construction for the connection lines for the compressed air or the like to the pressure applying member. However, in accordance with a preferred embodiment, the pressure applying member may be movable relative to the discs for selective movement along a path of travel which extends perpendicular to the plane defined by the axes of rotation of the discs. By such selective movement, it is possible to change the position of the twisting zone, and the ratio of conveyance and twist components imparted to the yarn, to thereby increase the versatility of the apparatus.

While the present invention is suitable for use with a yarn false twisting apparatus consisting of rigid discs, it is preferable to make one or both of the discs of a soft, flexible material as described above. Where each friction disc is composed of a flexible material, two pressure applying members may be required which are arranged in opposing relation to act upon the back side of the respective discs.

Some of the objects and advantages of the invention having been stated, others will appear as the description proceeds, when taken in connection with the accompanying drawings, in which FIG. 1 is a schematic front elevation view of a yarn false twisting apparatus embodying the features of the present invention, and with the friction discs oriented to impart an S twist to the yarn;

Figure 1:
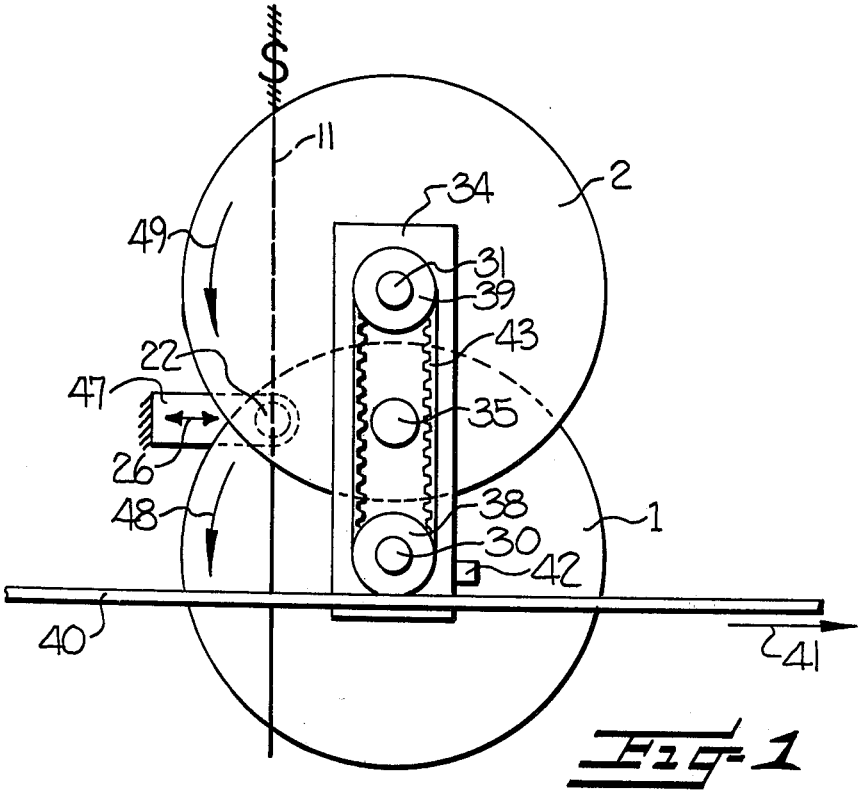
Figure 2:
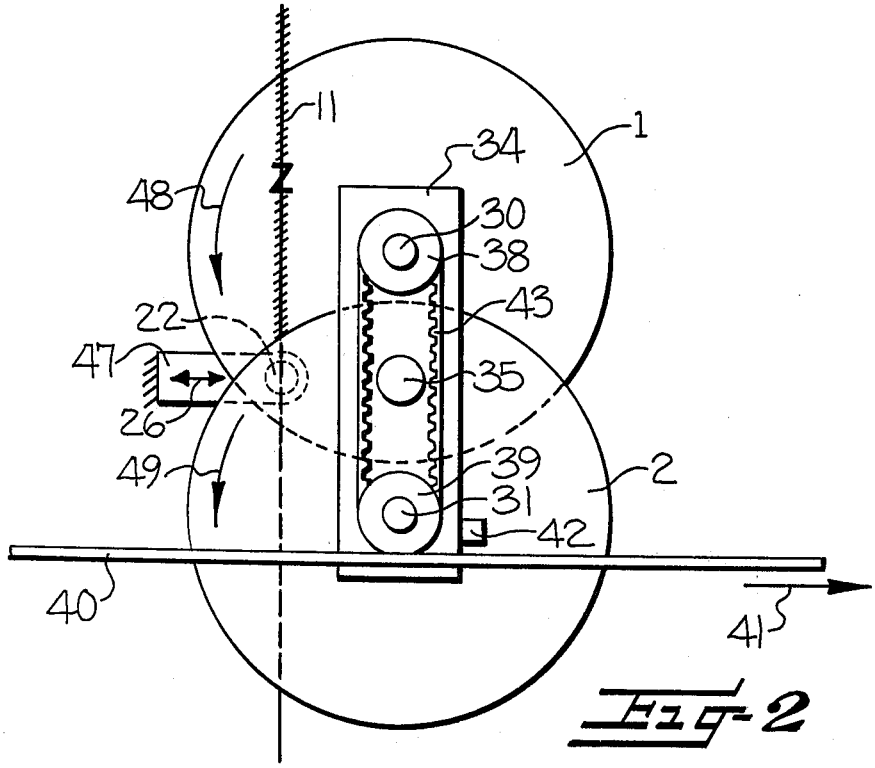
FIG. 2 is a view similar to FIG. 1, but illustrating the apparatus oriented to impart a Z twist.
Figure 3:
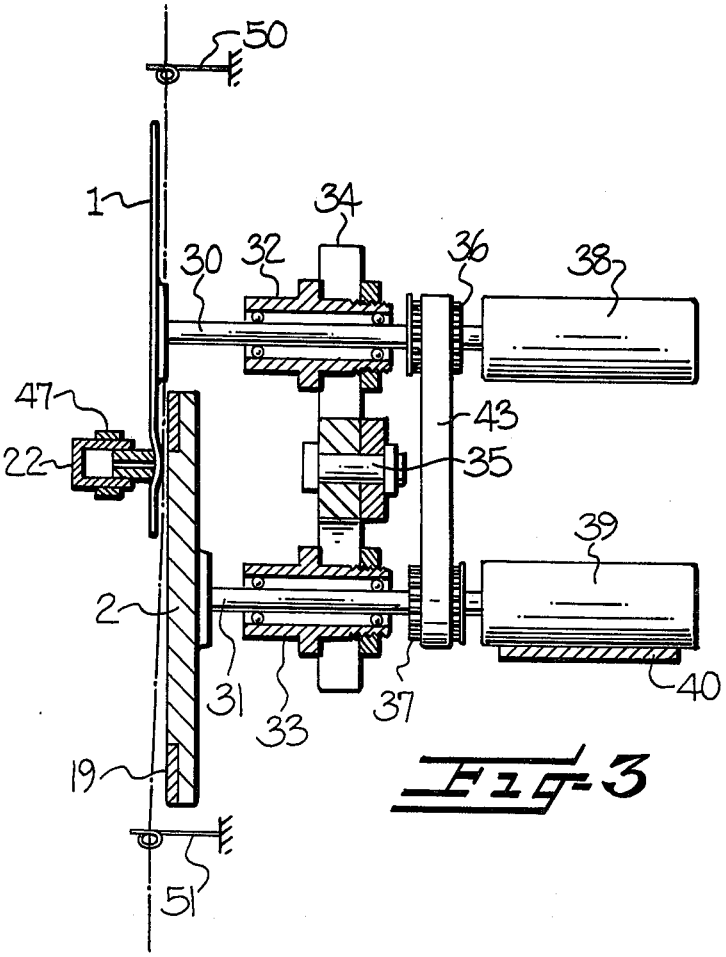
FIG. 3 is a sectional side elevation view of the apparatus as shown in FIG. 2.

Referring more specifically to the drawings, FIGS. 1–3 schematically illustrate a yarn false twisting apparatus embodying the features of the present invention, and which comprises a pair of twist imparting discs 1 and 2, which are mounted to the drive shafts 30, 31. The discs each have a yarn engaging friction surface on one face thereof, and they are mounted such that portions of the respective yarn engaging friction surfaces are disposed in opposing, substantially non-contacting relationship and define a twisting zone at 22 therebetween. A yarn 11 is guided between the discs and through the twisting zone, and in a direction parallel to a line extending perpendicularly between the axes of rotation of the discs 1 and 2. By this arrangement, a twist is imparted to the advancing yarn by the frictional contact between the yarn and the respective opposed friction surfaces.

Disc 1 is preferably flexible, which may be achieved by fabricating the disc of a relatively thin pliable material which may be deflected from its normal plane relative to its axis of rotation by a pressure applying member 22. Specifically, the disc 1 may be composed of a sheet of rubber or similar material, and have similar physical properties as transmission belts or air tubes in vehicle tires. Also, the disc 1 may consist of a flexible material, such as a thin steel plate, having a suitable friction coating in the area where yarn is nipped. In either case, the pressure applying member 22 upsets or deflects the disc 1 only at the twisting zone, and so that the yarn is nipped and false twisted between the opposing faces of the discs 1 and 2.

As illustrated, the disc 2 is made of a rigid or essentially unyielding material, and its friction surface is provided with a coating 19 having advantageous frictional and wearing properties.

The discs are mounted to the frame by a structure which includes a common carrier plate 34 which mounts the discs for rotation about essentially parallel, spaced apart axes in the manner described above. More particularly, each of the shafts 30, 31 is mounted in a bearing housing 32, 33 respectively, and the bearing housings are mounted on the carrier plate 34. The carrier plate 34 is pivotally mounted to the frame of the apparatus for selective rotation about the axis of the stationary pin 35 and for selective rotation between a first operative position as shown in FIG. 1, and a second operative position disposed about 180 degrees from the first position and as seen in FIG. 2. The axis of the pin 35 is disposed parallel to the axes of rotation of the discs and so as to perpendicularly bisect a line extending perpendicularly between such axes of rotation.

Each of the drive shafts 30, 31 projects rearwardly beyond the carrier plate 34 and each mounts a toothed belt pulley 36, 37 respectively. Further, each end of each shaft mounts a drive whorl 38, 39, respectively, which are alternately pressed against and driven by an endless tangential belt 40 which moves in a horizontal plane along the machine in the direction of arrow 41, and which returns and is driven in a manner not shown here in detail. A segment of the endless tangential belt 40 is adapted to drive the whorl 38 or 39 of a row of staggered false twist units, should this be desirable by reason of a narrow machine gauge (not shown). In order to prevent the carrier plate 34 from inadvertently pivoting from one of its operative positions, there is further provided a stationary locking bolt 42 which is removed when the carrier plate 34 is to be pivoted to a second operative position for the purpose of changing twist from S to Z, or vice versa.

The whorl 38 or 39 which is driven by the tangential belt 40, acts to rotate its associated shaft, as well as the other shaft via a power transmitting means in the form of a toothed belt 43, which is entrained about the pulleys 36, 37. Thus the two drive shafts 30, 31 of discs 1 and 2 are driven without slippage in common rotational directions.

Figure 4:
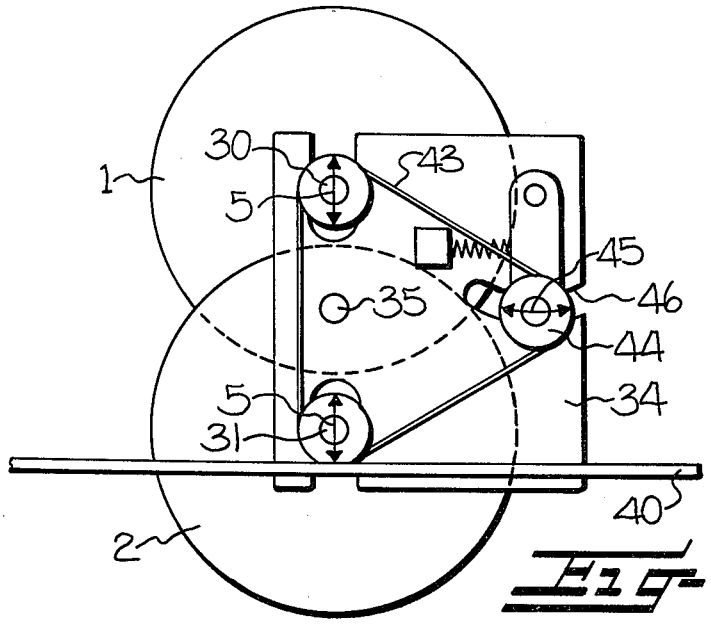
FIG. 4 is a schematic front elevation view of a second embodiment of the invention.

In the embodiment of FIG. 4, each shaft is mounted to the carrier plate by means which permit selective movement of the shafts along a direction parallel to a line extending perpendicularly therebetween, i.e., in the direction of arrow 5. Also, a tensioning pulley 44 is mounted on the carrier plate 34, which may be moved and secured in the direction 45 as defined by a guide slot 46, for the purpose of tensioning or slackening the toothed belt 43.

The pressure applying member 22 is fixed to the frame of the apparatus by a support 47. By design, the member may be displaced in guideways (not shown) relative to the machine frame, and is normally adjusted so that it is arranged at the apex of an isosceles triangle formed with the axes of the discs 1 and 2. As noted above, the member 22 acts to bias the back side of the flexible disc 1, thereby locally upsetting the same toward the other disc 2 to nip the yarn therebetween. The guideway for the member is so designed that the member may be displaced for movement along a path of travel which extends in a direction 26 which is perpendicular to the plane defined by the axes of rotation of the discs in each of its first and second operative positions. By this arrangement, it is possible to change the ratio of yarn advance to twist imparted by the discs 1 and 2 on the yarn 11.

As noted above, in the false twist apparatus according to the invention illustrated in FIGS. 1–3, the twist may be changed from S to Z by simply pivoting carrier plate 34 about the axis of pin 35 by approximately 180 degrees. In so doing, the position of the pressure applying member, and the rotational direction 48 of the discs 1 and 2 will remain unchanged. Further, the friction surfaces of the discs which act on the yarn are transposed relative to the drive shafts 30, 31, and thus the direction of the forces acting on the yarn 11 is reversed, to thereby permit the ready conversion from an S twist to a Z twist, or vice versa. Further, it should be noted that the yarn is conducted through the guides 50 and 51 while passing between the discs 1 and 2, so that it essentially contacts the discs only at the twisting zone. Also, it will be noted that the yarn path of travel remains unchanged in the two operative positions of the discs.

In the drawings and specification, there has been set forth a preferred embodiment of the invention and although specific terms are employed, they are used in a generic and descriptive sense only and not for purposes of limitation.

That which is claimed is:

1. A yarn false twisting apparatus characterized by the ability to readily convert from S to Z twist and vice versa, and comprising a frame, a pair of twist imparting discs, with each disc having a yarn engaging friction surface on one face thereof, means mounting said discs to said frame and including a carrier plate mounting said discs for rotation about essentially parallel, spaced apart axes and such that portions of the respective yarn engaging friction surfaces are disposed in opposing, substantially non-contacting relationship and define a twisting zone therebetween, and including means pivotally mounting said carrier plate to said frame for selective rotation between first and second operative positions disposed about 180 degrees from each other, and drive means for rotating each of said discs in a common rotational direction at each of said first and second operative positions, whereby a yarn may be continuously moved through said twisting zone in a direction parallel to and laterally spaced from a line extending perpendicularly between said axes of rotation and so as to have twist imparted thereto by frictional contact between the yarn and the respective opposed friction surfaces, and wherein conversion from S to Z twist or vice versa may be readily effected by pivoting said carrier plate between said first and second operative positions and without changing the direction of rotation of the discs or the yarn path of travel.

2. The yarn false twisting apparatus as defined in claim 1 wherein said carrier plate is rotatable about an axis disposed parallel to said axes of rotation of said discs and so as to perpendicularly bisect a line extending perpendicularly between said axes of rotation.

3. The yarn false twisting apparatus as defined in claim 2 wherein said discs each include a shaft extending along its axis of rotation, and said drive means includes a pulley mounted on each shaft and an endless drive belt operatively engaging each pulley.

4. The yarn false twisting apparatus as defined in claim 3 wherein said drive means further includes a drive whorl coaxially disposed on each disc shaft, and tangential belt means operatively contacting respective ones of said whorls in each of said first and second operative positions of said carrier plate.

5. The yarn false twisting apparatus as defined in claim 3 wherein each shaft is mounted to said carrier plate by means permitting selective movement along a direction parallel to a line extending perpendicularly between said shafts.

6. The yarn false twisting apparatus as defined in claim 5 further comprising tensioning means for maintaining a desired tension on said endless drive belt upon selective movement of said shafts on said carrier plate.

7. The yarn false twisting apparatus as defined in any one of claims 1–6 wherein at least one of said discs is relatively thin and flexible, and said apparatus further comprises a pressure applying member, and means mounting said pressure applying member to said frame so as to locally bias said one flexible disc toward the other disc in each of said first and second operative positions.

8. The yarn false twisting apparatus as defined in claim 7 wherein said means mounting said pressure applying member to said frame includes means mounting the same for selective movement along a path of travel which extends perpendicular to the plane defined by the axes of rotation of said discs in each of said first and second operative positions.

9. A method of false twisting a yarn and converting from S to Z twist or vice versa, and comprising the steps of providing a pair of twist imparting circular discs, with each disc including a yarn engaging friction surface, and with said discs being rotatably mounted on a common carrier plate for rotation about parallel spaced apart axes and such that portions of the respective yarn engaging friction surfaces are disposed in opposing, face to face relationship, and define a twisting zone therebetween, rotating each of said discs in a common direction about their respective axes, while advancing a yarn along a path of travel through said twisting zone in a direction parallel to a plane defined by the axes of rotation of said discs so as to have twist imparted thereto by frictional contact between the yarn and the respective opposed friction surfaces, and then reversing the positioning of said discs by rotating said carrier plate through approximately 180 degrees about an axis disposed intermediate said disc axes of rotation, and maintaining the same direction of rotation of each disc and the yarn path of travel, to thereby convert from S to Z twist or vice versa.

10. A method of false twisting a yarn and converting from S to Z twist or vice versa, and comprising the steps of providing a pair of twist imparting circular discs, with each disc including a yarn engaging friction surface, and with at least one of said discs being relatively thin and flexible, and with said discs being rotatably mounted on a common carrier plate for rotation about parallel spaced apart axes and such that portions of the respective yarn engaging friction surfaces are disposed in opposing, face to face relationship, providing a pressure applying member, with said pressure applying member being positioned intermediate said axes of rotation of said discs and so as to locally bias said one flexible disc toward the other disc and thereby define a twisting zone, rotating each of said discs in a common direction about their respective axes, while advancing a yarn along a path of travel through said twisting zone in a direction parallel to a plane defined by the axes of rotation of said discs so as to have twist imparted thereto by frictional contact between the yarn and the respective opposed friction surfaces resulting from the force exerted by said pressure applying member, and then reversing the positioning of said discs by rotating said carrier plate through approximately 180 degrees about an axis disposed intermediate and parallel to said disc axes of rotation, and such that each axis of rotation is disposed on the opposite side of said pressure applying member from its original position and maintaining the same direction of rotation of each disc and the yarn path of travel, to thereby convert from S to Z twist or vice versa.

* * * * *